US009435500B2

(12) United States Patent
Boomgaarden et al.

(10) Patent No.: US 9,435,500 B2
(45) Date of Patent: Sep. 6, 2016

(54) MODULAR SEGMENTED ELECTRONICS ASSEMBLY

(71) Applicant: LIGHTING SCIENCE GROUP CORPORATION, Satellite Beach, FL (US)

(72) Inventors: Mark Penley Boomgaarden, Satellite Beach, FL (US); Ricardo Romeu, Melbourne, FL (US); Eric Holland, Indian Harbour Beach, FL (US); Raymond Reynolds, Satellite Beach, FL (US)

(73) Assignee: Lighting Science Group Corporation, Cocoa Beach, FL (US)

( * ) Notice: Subject to any disclaimer, the term of this patent is extended or adjusted under 35 U.S.C. 154(b) by 155 days.

(21) Appl. No.: 14/096,538

(22) Filed: Dec. 4, 2013

(65) Prior Publication Data

US 2014/0168932 A1 Jun. 19, 2014

Related U.S. Application Data

(60) Provisional application No. 61/733,044, filed on Dec. 4, 2012.

(51) Int. Cl.
*F21S 8/08* (2006.01)
*F21V 23/02* (2006.01)
(Continued)

(52) U.S. Cl.
CPC ..... *F21S 8/085* (2013.01); *F21V 23/023* (2013.01); *F21S 2/005* (2013.01); *F21W 2131/103* (2013.01)

(58) Field of Classification Search
CPC .. F21W 2131/103; F21S 8/086; F21S 2/005; F21S 8/085; Y02B 20/72; F21V 23/023
USPC ..... 362/217.16, 285, 249.11, 249.03, 362, 362/431, 430, 20
See application file for complete search history.

(56) References Cited

U.S. PATENT DOCUMENTS 5,136,489 A * 8/1992 Cheng ..... F21S 8/04 362/285
5,963,192 A 10/1999 Wong et al.
(Continued)

FOREIGN PATENT DOCUMENTS

DE 202005013164 11/2005
DE 102005059362 9/2006
(Continued)

OTHER PUBLICATIONS

European Search Report for European Application No. 10161574.8 dated Sep. 8, 2010.
(Continued)

*Primary Examiner* — Elmito Breval
*Assistant Examiner* — Arman B Fallahkhair
(74) *Attorney, Agent, or Firm* — Mark Malek; Daniel Pierron; Widerman Malek, PL

(57) ABSTRACT

A modular segmented street lighting device comprises an attaching member that is attachable to a street lamp pole, the attaching member comprising an electrical connector adapted to be electrically coupled to a power source associated with the street lamp pole. The modular segmented street lighting device also includes a docking member that is removably attachable to the attaching member, and comprises a power supply unit, and a load member that is removably attachable the attaching member and/or the docking member. The docking member is adapted to electrically couple the power supply unit to the electrical connector of the attaching member when the docking member is attached to the attaching member. The load member is adapted to electrically couple the lighting device to the power supply unit when the load member is attached to the attaching member and/or the docking member.

18 Claims, 6 Drawing Sheets

(51) Int. Cl.

| | |
|---|---|
| *F21S 2/00* | (2016.01) |
| *F21W 131/103* | (2006.01) |

(56) References Cited

U.S. PATENT DOCUMENTS

| | | | | |
|---|---|---|---|---|
| 6,149,283 | A | 11/2000 | Conway et al. | |
| 6,150,774 | A | 11/2000 | Mueller et al. | |
| 6,250,774 | B1 | 6/2001 | Begemann et al. | |
| 6,598,996 | B1 | 7/2003 | Lodhie | |
| 6,601,984 | B2 | 8/2003 | Yamamoto et al. | |
| 6,624,845 | B2 | 9/2003 | Lloyd et al. | |
| 6,676,279 | B1 | 1/2004 | Hubbell et al. | |
| 6,705,744 | B2 | 3/2004 | Hubbell et al. | |
| 6,774,916 | B2 | 8/2004 | Pettitt et al. | |
| 6,811,258 | B1 | 11/2004 | Grant | |
| 6,906,852 | B1 | 6/2005 | Russell | |
| 6,989,983 | B2 | 1/2006 | Rummey | |
| 7,014,336 | B1 | 3/2006 | Ducharme et al. | |
| 7,093,956 | B2 | 8/2006 | Miller et al. | |
| 7,095,056 | B2 | 8/2006 | Vitta et al. | |
| 7,163,325 | B2 | 1/2007 | Kojima et al. | |
| 7,347,706 | B1 * | 3/2008 | Wu et al. | 439/320 |
| 7,369,056 | B2 | 5/2008 | McCollough | |
| 7,628,508 | B2 | 12/2009 | Kita et al. | |
| 7,641,363 | B1 * | 1/2010 | Chang et al. | 362/294 |
| 7,699,498 | B2 * | 4/2010 | Zheng | 362/249.02 |
| 7,731,383 | B2 | 6/2010 | Myer | |
| 7,759,854 | B2 | 7/2010 | Miller et al. | |
| 7,777,166 | B2 | 8/2010 | Roberts | |
| 7,845,823 | B2 | 12/2010 | Mueller et al. | |
| 7,850,321 | B2 | 12/2010 | Wang et al. | |
| 7,850,335 | B2 | 12/2010 | Hsu et al. | |
| 7,863,829 | B2 | 1/2011 | Sayers et al. | |
| 7,909,479 | B2 | 3/2011 | Rooymans | |
| 7,942,537 | B2 | 5/2011 | Krijn et al. | |
| 7,959,320 | B2 | 6/2011 | Mueller et al. | |
| 7,972,030 | B2 | 7/2011 | Li | |
| 8,021,021 | B2 | 9/2011 | Paolini | |
| 8,040,102 | B2 | 10/2011 | Kao et al. | |
| 8,061,869 | B2 | 11/2011 | Lo et al. | |
| 8,096,685 | B2 | 1/2012 | Lu et al. | |
| 8,100,552 | B2 | 1/2012 | Spero | |
| 8,118,456 | B2 | 2/2012 | Reed et al. | |
| 8,130,099 | B2 | 3/2012 | Steinel et al. | |
| 8,136,969 | B2 | 3/2012 | Burkett et al. | |
| 8,143,811 | B2 | 3/2012 | Shloush et al. | |
| 8,193,713 | B2 | 6/2012 | Jung et al. | |
| 8,256,921 | B2 | 9/2012 | Crookham et al. | |
| 8,308,318 | B2 | 11/2012 | Maxik et al. | |
| 8,475,002 | B2 | 7/2013 | Maxik et al. | |
| 8,491,153 | B2 | 7/2013 | Maxik et al. | |
| 8,547,022 | B2 * | 10/2013 | Summerford et al. | 315/113 |
| 8,783,906 | B2 * | 7/2014 | Best et al. | 362/249.02 |
| 2005/0265023 | A1 | 12/2005 | Scholl | |
| 2006/0056169 | A1 | 3/2006 | Lodhie et al. | |
| 2007/0081339 | A1 | 4/2007 | Chung et al. | |
| 2008/0043464 | A1 | 2/2008 | Ashdown | |
| 2008/0055065 | A1 | 3/2008 | Feldmeier | |
| 2008/0089071 | A1 * | 4/2008 | Wang | 362/294 |
| 2009/0196038 | A1 * | 8/2009 | Vargas Maciel | 362/249.03 |
| 2009/0213588 | A1 * | 8/2009 | Manes | 362/235 |
| 2010/0271802 | A1 * | 10/2010 | Recker et al. | 362/20 |

FOREIGN PATENT DOCUMENTS

| | | |
|---|---|---|
| WO | WO 2005072279 | 8/2005 |
| WO | WO 2007069185 | 6/2007 |
| WO | WO 2008019481 | 2/2008 |

OTHER PUBLICATIONS

Proefrock, Philip, "LED Street Lights," 18 pp., Apr. 1, 2007.
LEDs Magazine—Streelighting; "On the verge: LEDs are ready to challenge incumbent light sources in the streetlighting market"; Oct. 2006; pp. 11-13, 16 & 17.
Swillas Engineering LTD; "Solar Street Lights"; 2005; 3 pp.

* cited by examiner

MODULAR SEGMENTED ELECTRONICS ASSEMBLY

RELATED APPLICATIONS

This application claims benefit under 35 U.S.C. §120 of U.S. Provisional Patent Application Ser. No. 61/733,044 titled Modular Segmented Electronics Assembly filed Dec. 4, 2012, the content of which is incorporated in its entirety herein by reference.

FIELD OF THE INVENTION

The present invention relates to modular electronic assemblies and associated methods.

BACKGROUND OF THE INVENTION

Chassis for electronic devices including modular designs have largely been tailored to indoor-based scenarios. A standard system may include a chassis and an electronic device disposed within and carried by a modular housing. For example, U.S. Pat. No. 6,989,983 titled Mounting Arrangement for Demountable Units discloses an arrangement of structural features to enable rack-mounting of modular electrical circuits. The system includes a housing having structural features that, when inserted into a rack mount structure, engages with the rack mount to carry the housing. Moreover, the system may include electrical connectors on the housing configured to connect with electrical connectors on the rack system upon disposal therein, creating an electrical coupling therebetween. However, such a system is intended only for indoor use and does not disclose structural elements to protect the electrical circuits from elemental factors, such as wind, precipitation, etc. Moreover, such a system does not address the need for additional structural support for elements extending beyond the front end of the housing.

Additionally, server rack mounts, as known in the art, are typically configured to be wheeled structures, affixed to the ground, floor, or other horizontal surface, or remain generally unattached, but merely disposed upon the horizontal surface. Furthermore, the method of attachment of such server rack mounts has typically been fasteners, such as screws, nails, and the like, being generally permanent and not easily undone so as to detach the server rack mount from the horizontal surface. Accordingly, there is a need for a mounting structure that enables attachment to non-traditional external structures, and that the method of mounting be detachable in nature.

Additionally, electrical devices disposed along the sides of streets, such as street lamps, have typically been non-modular in nature. That is to say, the failure of a single electrical component in the device, other than the illuminant in street lamps, has necessitated either time-consuming repair work or replacement of the entire electrical device. Accordingly, there is a need in the art for a system including modular components so as to facilitate more rapid and economical replacement of electrical components of the system.

Finally, installation of electrical devices disposed alongside streets typically includes a significant amount of risk of electrical shock due to the need for wiring the electrical device into a high-powered electrical grid. Accordingly, individuals with significant training must establish the connection between the electrical device and the power grid.

However, similar to above, due to the non-modular design of current electrical devices, such as street lamps, that same individual must perform the complete installation of the electrical device, as the non-modular design of the electrical device necessitates a person with that training to avoid electrical shock at many steps along the installation process. This results in a loss of cost efficiency in the form of human capital in the installation process. Accordingly, there is a need for a system that reduces the risk of electrical shock once an electrical connection to a power source, such as a power grid, has been established.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a modular segmented street lighting device. The street lighting device may comprise an attaching member adapted to be attachable to a street lamp pole. The attaching member may comprise an electrical connector adapted to be electrically coupled to a power source associated with the street lamp pole. The street lighting device may further comprise a docking member adapted to be removably attachable to the attaching member. The docking member may comprise a power supply unit. Additionally, the street lighting device may further comprise a load member adapted to be removably attachable to at least one of the attaching member and the docking member. The load member may comprise a lighting device. The docking member may be adapted to electrically couple the power supply unit to the electrical connector of the attaching member when the docking member is attached to the attaching member. Furthermore, the load member may be adapted to electrically couple the lighting device to the power supply unit when the load member is attached to at least one of the attaching member and the docking member.

In some embodiments, the street lighting device may further comprise an upper cover member and a lower cover member. The upper and lower cover members may be configured to be disposed about, and substantially shield, at least one of the attaching member, the docking member, and the load member from environmental factors.

In some embodiments the attaching member may further comprise a back wall and one or more cover walls. The back wall and the cover walls may cooperate to define a bay and a shield volume. Additionally, the docking member may be configured to be positioned at least partially within the bay. In some embodiments the back wall may comprise an opening configured to permit the positioning of an object partially within the bay and partially within the shielded volume. Additionally, in some embodiments, one or more of the cover walls may comprise at least one feature selected from the group consisting of slots, grooves, ridges, slopes, and tapers. Additionally, one or more of the cover walls may comprise a feature configured to increase the thermal dissipation capacity of the street lighting device. Furthermore, in some embodiments, one or more of the cover walls may comprise a slot configured to facilitate the attachment of the docking member with the attaching member in a selected orientation. Additionally, the docking member may comprise an outcropping configured to be received by the slot so as to position the docking member in a selected orientation.

In some embodiments one or more of the cover walls may comprise a slot configured to permit the positioning of an electrical device therein or therethrough.

In some embodiments the docking member may be configured to be attached to the attaching member by translating longitudinally into the bay. Additionally, in some embodiments the docking member may be configured to form an open circuit when the load member is not attached thereto.

In some embodiments the power supply unit may comprise two power supply units and a control unit. The control unit may be configured to operate a first of the two power supply units to provide power to the load unit. Additionally, the control unit may be configured to detect a failure of the first power supply unit. Furthermore, the control unit may be configured to, upon a detection of the failure of the first power supply unit, operate the second of the two power supply units to provide power to the load member. Additionally, the street lighting device may further comprise a communication device positioned in communication with a network. The control unit is configured to generate a signal indicating the failure of the first power supply unit to be transmitted by the communication device and received by a receiver across the network.

The street lighting device according to an embodiment of the present invention may further comprise a controller, and the load member may comprise a load electrical device positioned in electrical communication with the controller. The controller may be configured to control the operation of the load electrical device.

The docking member of the lighting device according to an embodiment of the present invention may comprise a primary connector. The load member may additionally comprise a load connector. The load connector may be configured to electrically couple to the primary connector when the load member is attached to the docking member. Additionally, the primary connector may be configured to facilitate engagement with the load connector by permitting engagement in a range of angles of approach, rotation, horizontal rotation, and vertical translation.

Additionally, an embodiment of the present invention is directed to a modular segmented street lighting device comprising an attaching member adapted to be attachable to a street lamp pole. The attaching member may comprise an electrical connector adapted to be electrically coupled to a power source associated with the street lamp pole, a back wall, and one or more cover walls. At least one of the one or more cover walls may include a slot configured to facilitate the attachment of the docking member to the attaching member in a selected orientation. The back wall and the cover walls may cooperate to define a bay and a shield volume. The street lighting device may further comprise a docking member adapted to be removably attachable to the attaching member. The docking member may comprise a power supply unit and an outcropping configured to be received by the slot of the cover walls so as to position the docking member in a selected orientation. The street lighting device may further comprise a load member, which may comprise a lighting device, adapted to be removably attachable to at least one of the attaching member and the docking member. The docking member may be adapted to electrically couple the power supply unit to the electrical connector of the attaching member when the docking member is attached to the attaching member. Additionally, the docking member may be configured to be positioned at least partially within the bay. Furthermore, the docking member may be configured to be attached to the attaching member by translating longitudinally into the bay. The load member may be adapted to electrically couple the lighting device to the power supply unit when the load member is attached to at least one of the attaching member and the docking member.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as “above,” “below,” “upper,” “lower,” and other like terms are used for the convenience of the reader in reference to the drawings. Also, a person skilled in the art should notice this description may contain other terminology to convey position, orientation, and direction without departing from the principles of the present invention.

In this detailed description of the present invention, a person skilled in the art should note that technical terms, such as "wired" and "wireless" and other terms are used for convenience, as the various forms of wired and wireless communication, as well as the standards and protocols included therein, are known in the art. Such standards include, not by way of limitation or exclusion by omission, 802.11/WiFi communication standards, Bluetooth, Zigbee, RuBee, Near-Field Communication (NFC), any type of cellular network communication standard, including GSM, GPRS, CDMA, EV-DO, EDGE, 3G, DECT, OFDMA, WIMAX, and LTE, and wired communication standards, such as Ethernet, USB, FireWire, Thunderbolt, and all other communication standards are included within the invention.

Figure 1:
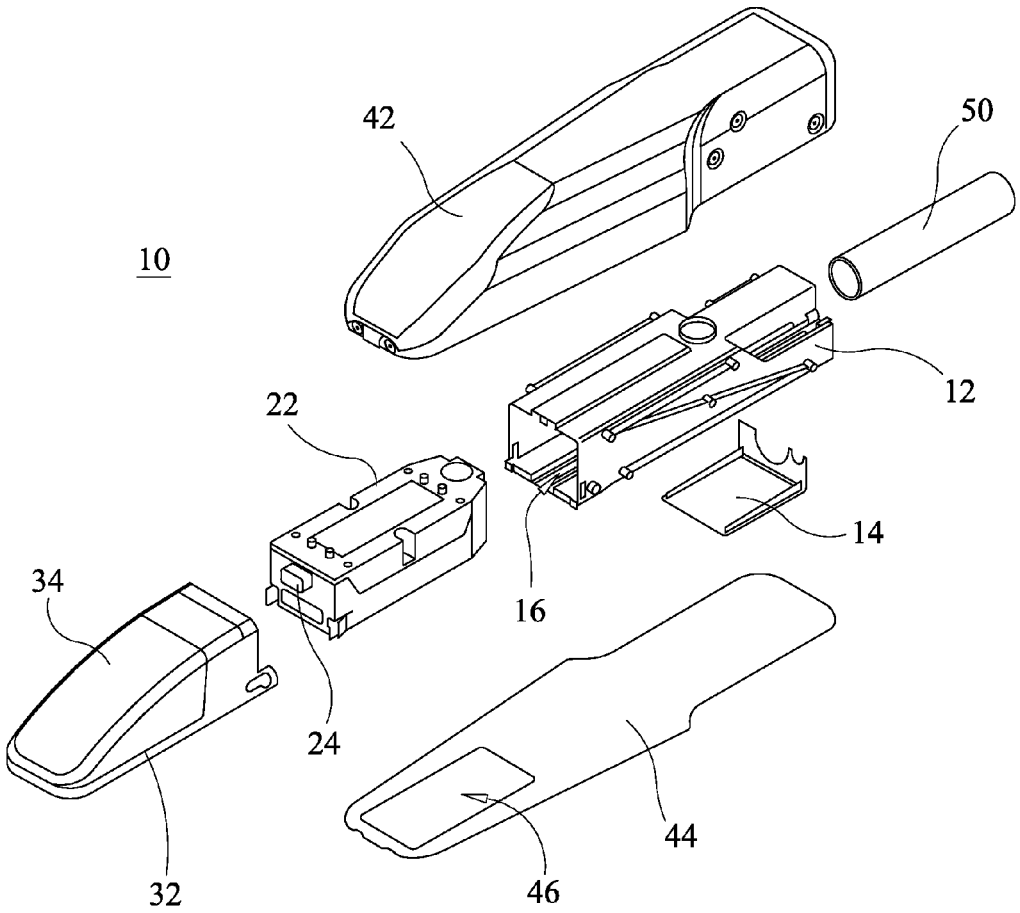
FIG. 1 is an exploded view of a modular segmented electronics assembly according to an embodiment of the present invention.

An embodiment of the invention, as shown and described by the various figures and accompanying text, is depicted in FIG. 1, providing a modular segmented electronics assembly 10. More specifically, the invention provides an assembly 10 including an attaching member 12, a docking member 22, a load member 32, an upper cover member 42, and a lower cover member 44. The assembly and function of the elements of the assembly 10 are substantially as described for alternative embodiments and their like elements hereinbelow.

The attaching member 12 may be configured to be removably attachable to an external structure 50, such as a street lamp pole. The attaching member 12 may further include a detachable section 14 that is configured to be attached to the attaching member 12 after the attaching member 12 has been attached to the external structure 50.

The attaching member 12 may further include an internal void 16 within which the docking member 22 may be at least partially positioned within. When so positioned, the docking member 22 may be electrically coupled with electrical connectors associated with the external structure 50. The docking member 22 may be configured to be removably attached to the attaching member 12 when positioned at least partially within the internal void 16. The docking member 22 may contain various electrical elements as described for other embodiments hereinbelow.

The docking member 22 may further include a proximal connector 24 configured to electrically couple with the load member 32. Furthermore, the docking member 22 may include structural elements configured to removably attach the load member 32 to the docking member 22. The proximal connector and the structural elements may be configured as described for alternative embodiments hereinbelow. The load member 32 may include electrical elements also as described for alternative embodiments hereinbelow. The load member 32 may further include a displaceable cover 34 that may be displaceable between a closed position where it substantially covers the electrical elements of the load member 32 and an open position where it generally exposes the electrical elements of the load member 32, thus facilitating access to the electrical elements for their repair, replacement, or any other modification.

The upper cover member 42 and the lower cover member 44 may be configured to be disposed about and substantially shield the attaching member 12, the docking member 22, and the load member 32 from environmental factors, such as precipitation, wind, dirt, or any other potentially harmful or damaging factor. Furthermore, the lower cover member 44 may include an aperture 46 that may be configured to facilitate the operation of the load member 32, such as permitting the propagation of light emitted from the load member 32 to pass therethrough. The upper and lower cover members 42, 44 may be removably attached to each other and/or any other elements of the assembly 10 by any suitable means, method, or device, including, without limitation, fasteners, glues, adhesives, welding, magnetism, electromagnetism, clasps, snaps, or any other attachment.

An alternative embodiment of the invention, as shown and described by the various figures and accompanying text, is depicted in FIGS. 2-11, providing a modular segmented electronics assembly 100. More specifically, the invention provides an assembly 100 including an attaching member 102, a docking member 202, and a load member 302. The attaching member 102 and docking member 202 may be configured to functionally couple to each other, and the docking member 202 and the load member 302 may be configured to functionally couple to each other.

Figure 2:
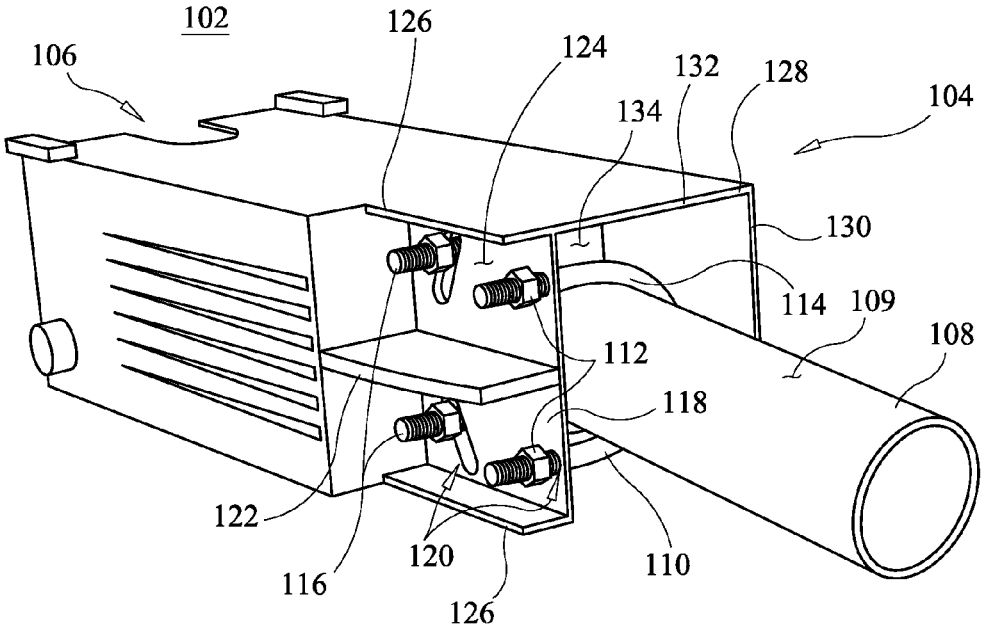
FIG. 2 is a perspective view of an attachment member of the modular segmented electronics assembly according to an embodiment of the present invention.

The attaching member 102 will now be discussed in greater detail. Referring to FIG. 2, the attaching member 102 of the current embodiment is depicted. The attaching member 102 may have a first end 104 and a second end 106, the first end 104 being generally towards a distal end of the attaching member 102 and the second end 106 being generally towards the proximal end of the attaching member 102. The first end 104 may be configured to attach to a structure 108, and the second end 106 may be configured to accommodate the docking member 202 being disposed therethrough.

The first end 104 of the attaching member 102 will now be discussed in greater detail. The first end 104 may be configured to enable the attachment of the attaching member 102 to the structure 108. The attachment of the first end 104 to the structure 108 may be of sufficient strength so as to resist loading forces experienced by the attaching member 102, including those forces resulting from subsequent attachment of the docking member 202 and the load member 302, forces exerted upon the docking member 202 and the load member 302 that are in turn 314 exerted upon the attaching member 102, and any other forces that may be exerted upon the assembly 100 due to environmental factors, including wind, rain, and matter accumulation on the assembly 100.

The attachment of the first end 104 to the structure 108 may be accomplished by any mechanism and method capable of accommodating and resisting the above-disclosed forces. In the present embodiment, the first end 104 is attached to a structure 108 by the employment of a nut-and-bolt attachment device. More specifically, the first end 104 is attached to a tubular structure 108 by a U-bolt 110 and accompanying nuts 112, the U-bolt 110 having a rounded section 114 and a pair of threaded sections 116 extending generally away from the rounded section 114. To facilitate the attachment of the attaching member 102 by use of a nut-and-bolt attachment device, the attaching member 102 may include an extending attaching section 118 having formed therein a slot 120 configured to permit the bolt of the nut-and-bolt attachment device to pass therethrough. The extending attaching section 118 may extend generally distally, in the direction of the first end 104, such an extension being configured to enable the structure 108 to be positioned generally parallel to the structure 108 and have a section that is generally co-extensive and interfaces with an outer surface 109 of the structure 108. In the present embodiment, where a U-bolt 110 is employed, the attaching member 102 may include a plurality of slots 120 configured to permit the threaded sections 116 of the U-bolt 110 to pass therethrough.

Furthermore, in the present embodiment, the structure 108 is attached to the attaching member 102 through the use of two U-bolts 110. Accordingly, the extending attaching section 118 may include two pairs of slots 120, each pair of slots 120 being associated with one of the two U-bolts 110. To attach the attaching member 102 to the structure 108, the rounded section 114 of each of the U-bolts 110 may be positioned to interface with the outer surface 109 of the structure 108. The threaded sections 116 of each of the U-bolts 110 may then be positioned to pass through the pair of slots 120 associated with each of the U-bolts 110. The U-bolts 110 may then be attached to the extending attaching section 118 by threading nuts 112 onto the threaded sections 116 of each U-bolt 110, clamping the structure 108 between the extending attaching section 118 and the U-bolts 110, thereby attaching the attaching member 102 to the structure 108.

The size and dimensions of the U-bolt 110 and the corresponding nuts 112 and slots 120, as well as all other suitable methods, mechanisms, structures, and devices for attaching the attaching member 102 to a structure, may be configured to permit the attachment of the attaching member 102 to structures of various sizes and shapes. For example, the U-bolt 110 of the present embodiment may be configured to accommodate and attach to tubular structures having an outer diameter of about 4 inches. More specifically, the rounded section 114 of the U-bolt 110 may define an inner diameter of slightly greater than 4 inches. An advantage of employment of a U-bolt to attach the attaching member 102 to a tubular structure is that tubular structures of a varying outer diameters may be accommodated by U-bolts of a single size. For example, the U-bolt 110 of the present embodiment may attach to tubular structures having outer diameters within the range of about 2 inches to about 4 inches. U-bolts of all others sizes, and their attending nuts and slots, are contemplated and included within the scope of the invention.

Still referring to FIG. 2, the attaching member 102 may be configured to enable various orientations of the assembly 100. More specifically, where the assembly 100 and the structure 108 each define a longitudinal axis, the attaching member 102 may be configured to permit the assembly 100 to be attached to the structure 108 such that the longitudinal axes are generally parallel to each other, skew to each other, or generally orthogonal to each other. In the present embodiment, enablement of various orientations may be enabled by configuring at least one of the pairs of slots 120 to have major and minor axes, similar to those of an ellipse. The minor axis must be at least slightly greater than an outer diameter of the threaded section 116 of the U-bolt 110 associated with the slot 120. The major axis may be configured to permit the assembly 100 to rotate about the tubular structure 108, thereby enabling various orientations of the longitudinal axes of the assembly 100 and the structure 108. In some embodiments, the slot 120 may be configured to be curved, thereby requiring the major axis to be curved.

The extending attaching section 118 may further include a web 122 extending generally orthogonally from a surface 124 of the extending attaching section 118 facing generally away from the structure 108. The web 122 may be configured to reduce any deflection of the extending attaching section 118 that may result from attachment of the assembly 100 to the structure 108 and any forces experienced by the assembly 100 once so attached. The extending attaching section 118 may include additional webs 126 to further increase the strength of the extending attaching section 118, further reducing its deflection as described.

The attaching member 102 may further include a covering member 128. The covering member 128 may be configured to at least partially shield the attachment of the attaching member 102 to the structure 108 from environmental elements, such as direct precipitation, wind, and radiation. The covering member 128 may include a first projecting section 130 and a second projecting section 132. The first projecting section 130 may be positioned generally orthogonal to the second projecting section 132. Furthermore, the first projecting section 130 may be positioned generally parallel to the extending attaching section 118, and the second projecting section 132 may be intersect with and be generally orthogonal to the extending attaching section 118. The first projecting section 130 and second projecting section 132 may be positioned so as to optimally shield the attachment between the extending attaching section 118 and the structure 108 from environmental elements. In the present embodiment, the first projecting section 130 may generally shield a side of the attachment between the extending attaching section 118 and the structure 108, and the second projecting section 132 may generally shield a top of the attachment between the extending attaching section 118 and the structure 108. Moreover, the covering member may cooperate with the extending attaching section 118 to thereby define a volume that is generally shielded from environmental elements. In the present embodiment, the structure 108 may be at least partially disposed within the shielded volume. Other objects or elements, associated or unassociated with the structure 108, may similarly be disposed within the shielded volume, discussed in greater detail hereinbelow. Other orientations of the cover member 128 and the extending attaching section 118 are contemplated and included within the scope of the invention.

The attaching member 102 may further include a back wall 134. The back wall 134 may be positioned to intersect with and attach to the extending attaching section 118, including any webs 122, and the covering member, including the first projecting section 130 and the second projecting section 132 of the present embodiment. Alternatively, the back wall 134 may be integrally formed with any of the intersecting elements of the attaching member 102. The back wall 134 may be configured to generally separate the proximal and distal ends of the attaching member 102.

Figure 3:
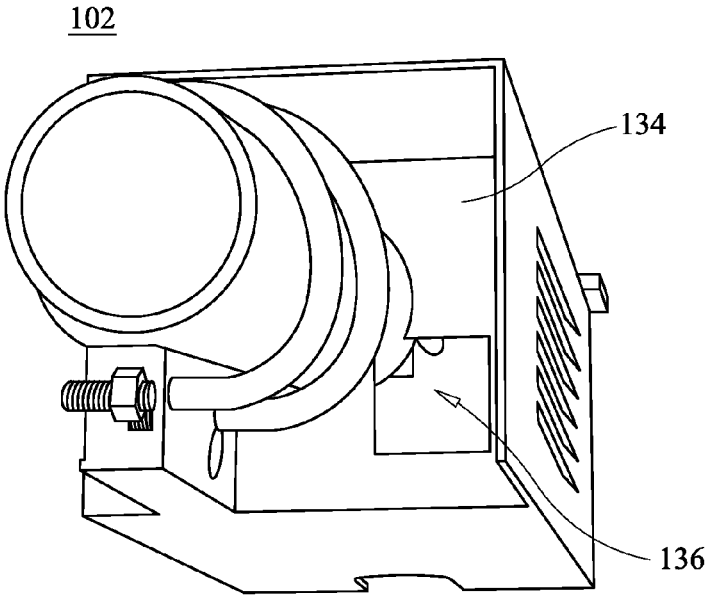
FIG. 3 is a side view of the attachment member depicted in FIG. 2.

Referring now to FIG. 3, the back wall 134 may further include an opening 136. The opening 136 may be formed in the back wall 134 in a position to permit an object to pass through the opening 136, allowing the object to be positioned on both sides of the back wall 134. Furthermore, the opening 136 may be formed in the back wall 134 in a position to permit an object to be disposed within the shielded volume as well as proximal to the back wall 134.

Figure 4:
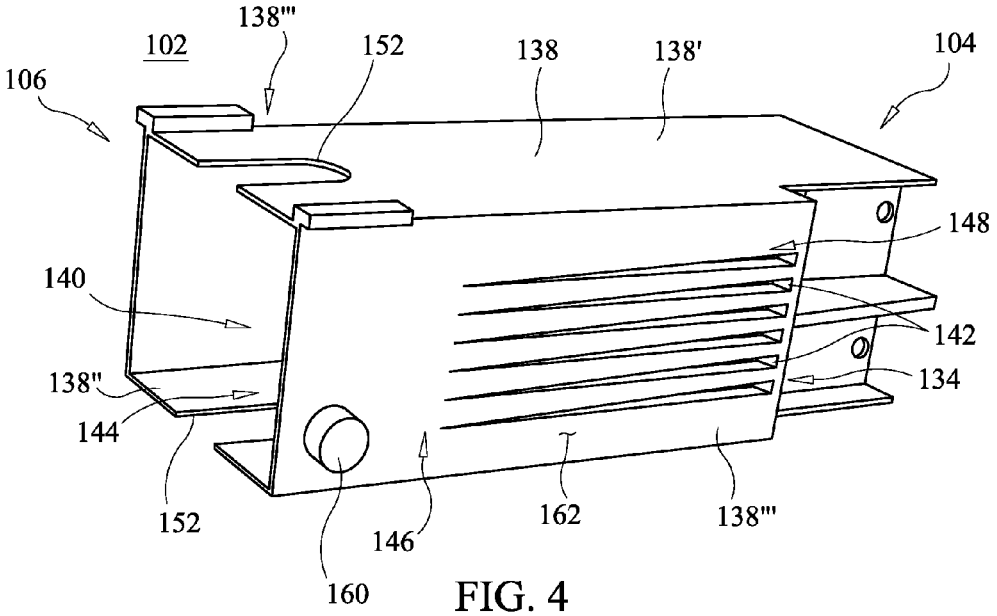
FIG. 4 is an alternate perspective view of the attachment member depicted in FIG. 2.

Referring now to FIG. 4, aspects the attaching member 102 will now be discussed in greater detail. The attaching member 102 may further include one or more cover walls 138. The cover walls 138 may extend generally proximally from the back wall 134. Additionally, the cover walls 138 may cooperate to define a bay 140 that is substantially bounded by the back wall 134 and the walls. Furthermore, the cover walls 138 may cooperate to define the second end 106 of the attaching member 102. The second end 106 may be generally open, thereby facilitating the positioning of an object within the bay 140. The cover walls 138 and the back wall 134 may be attached to each other in any arrangement so as to define the boundaries of the bay 140 to form the second end 106 to be open. In the present embodiment, the cover walls 138 include four cover walls 138 joined generally perpendicularly to each other and the back wall 134, creating a box-type bay 140. Any other quantity and geometric configuration of the cover walls 138, including circles, ellipses, triangles, rectangles, pentagons, hexagons, and any other polygon, are considered and within the scope of the invention.

The dimensions of the bay 140 are defined by the cooperation between the cover walls 138 and the back wall 134. The dimensions of the bay 140 may be configured through the configuration and dimensions of the defining elements, the cover walls 138 and the back wall 134. The bay 140 may be configured to accommodate the positioning of an object at least partially therewithin. In the present embodiment, the bay 140 may be configured to accommodate the docking member 202 to be at least partially disposed therewithin.

Additionally, where the back wall 134 includes an opening 136, the bay 140 may be in physical communication with the shielded volume. More specifically, an object may be positioned partially within the bay 140 and partially within the shielded volume.

The cover walls 138 may be attached to each other, the back wall 134, and any other element of the attaching member 102 by any method, mechanism, or device that is sufficient to maintain the structural integrity of the attaching member 102 and withstand the forces exerted thereupon. In some embodiments, the cover walls 138 may be integrally formed. In further embodiments, the cover walls 138 may be integrally formed with any or all of the back wall 134, extending attaching section 118, and covering member 128.

The cover walls 138 may include features, such as slots, grooves, ridges, slopes, tapers, or other structural features creating a multi-featured surface of the wall. The inclusion of features, and the selection of those features, may be to advantageously alter various characteristics of the cover walls 138 and, by implication, the attaching member 102, including by way of example thermal dissipation capacity.

For example, as depicted in the present embodiment, the cover walls 138 may include one or more sloped projecting sections 142. The sloped projecting sections 142 may be formed to project inward from an inside surface 144 of the containing cover walls 138 that define the boundary of the bat 140. The sloped projecting sections 142 may extend for some length along the containing cover wall 138. In the present embodiment, the sloped projecting sections 142 begin flush with the non-sloped sections 226 of the containing cover wall 138 at a generally proximal end 146 of the sloped projecting section 142 and extend generally inward, extending into the bay 140, toward a distal end 148 of the sloped projecting sections 142. The sloped projecting sections 142 may be positioned and configured to interface with a feature of an object disposed within the bay 140 to facilitate the removable attachment of the object to the attaching member 102. For example, the sloped projecting sections 142 may exert a compression force opposite to a force exerted by an object disposed within the bay 140 generally outward and against the sloped projecting sections 142. Accordingly, an interference fit may be established between the sloped projecting sections 142 and features of the object disposed within the bay 140.

Additionally, the sloped projecting sections 142 may be formed and configured to facilitate the transfer of heat from the attaching member 102, any object disposed within the bay 140, and any object in thermal communication with the attaching member 102. The sloped projecting sections 142 may increase the surface area of the outward-facing surface of the containing cover wall 138, thereby increase the amount of heat that can be dissipated thereby. The configuration of the sloped projecting sections 142 may be made so as to provide sufficient heat dissipation properties while also having sufficient mechanical strength to removably attach to the docking member 202, discussed in greater detail hereinbelow.

Additionally, the cover walls 138 may include a slot 152. The slot 152 may be formed in the containing cover wall 138 to facilitate the engagement of the cover wall 138, and by extension the attaching member 102, with an object disposed within the bay 140. The slot 152 may be configured to accommodate a physical feature of the objecting disposed within the bay 140, permitting the physical feature to be disposed substantially within the slot 152. Additionally, the slot 152 may be configured to facilitate the positioning of the object in the bay 140 by requiring a desirous orientation between the object and the attaching member 102. The slot 152 may be positioned at any point on the containing cover wall 138.

As shown in the present embodiment, where the cover walls 138 includes an upper wall 138', a lower wall 138", and side walls 138'", each of the upper wall 138' and lower wall 138" may include a slot 152 formed at a proximal end of the respective cover wall 138. The slot 152 may be configured to permit a physical feature of the docking member 202 to be positioned within the slot 152. Due to the symmetry of the slots 152 of the upper wall 138' and the lower wall 138", these features permit the docking member 202 to be disposed within the bay 140 in one of two orientations. Alternative embodiments may employ different combinations and orientations of slots 152 formed in the cover walls 138 to permit varying orientations between the object to be positioned within the bay 140, such as the docking member 202, and the attaching member 102.

In some embodiments, the slot 152 may be configured to permit an electrical device to be disposed therein or therethrough. In some other embodiments, the slot 152 may be configured to act as an aperture, void, or otherwise empty space to allow the unimpeded transmission of electromagnetic radiation therethrough, such as, for example, visible light, radio waves, and microwaves. Furthermore, other types of sensors, such as those to detect atmospheric and weather conditions may be positioned adjacent to the slot 152 and take advantage of the void in detecting environmental conditions. In one embodiment, the slot 152 may function as an aperture through which visible light may traverse and be incident upon a motion detector disposed within the slot.

The attaching member 102 may include additional features to further facilitate the removable attachment of the load member 302. In the present embodiment, the attaching member 102 may include an outcropping 160. The outcropping 160 may be positioned on an outer surface 162 of the containing cover wall 138 generally opposite the surface 144 of the cover wall 138 defining a boundary of the bay 140. Additionally, the outcropping 160 may extend generally away from the surface 162 of the containing cover wall 138. The outcropping 160 may be configured to permit a section of the load member 302 to be disposed substantially about the outcropping 160, thereby removably coupling the load member 302 to the outcropping 160 and, by extension, the attaching member 102. Furthermore, the outcropping 160 may be configured to facilitate the load member 302 to de-couple from the outcropping 160 and, hence, from the attaching member 102.

Further, the attaching member 102 may include additional structures or features that support or otherwise facilitate the removable attachment of the load member 302 to the attaching member 102. As shown in the present embodiment, the attaching member 102 may include one or more supports 150. The supports 150 may be positioned so as to facilitate the engagement between the attaching member 102 and the load member 302. Additionally, the supports 150 may serve to offset the load member 302 from the upper wall 138' so as to prevent rubbing, scraping, or any other undesirable interference between the upper wall 138' and the load member 302.

The various elements of the attaching member 102 may be formed of a variety of materials. Types of materials include metals, metal alloys, and polymers. Integrally molded elements will tend to be formed of the same material. The selection of material from which to form the various elements of the attaching member 102 may be based upon properties and characteristics of the material, including, without limitation, mechanical strength, response to different loading scenarios, electrical conduction/insulation, electromagnetic permittivity, thermal conduction/insulation, corrosion, weathering, casting properties, molding properties, extrusion properties, and any other material property.

Figure 5:
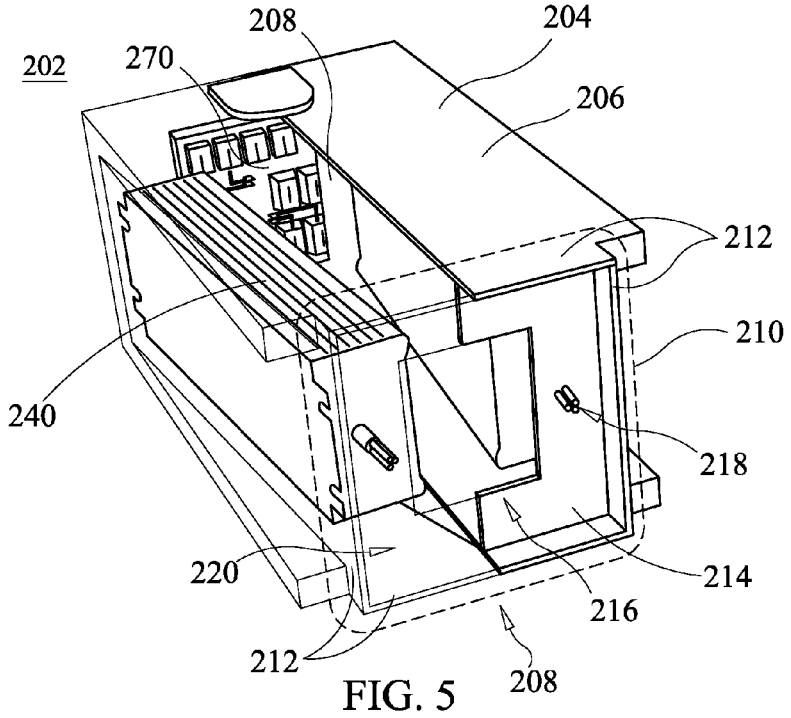
FIG. 5 is a perspective view of a docking member of the modular segmented electronics assembly according to an embodiment of the present invention having portions cut away to reveal interior portions thereof.

Referring now to FIG. 5, the docking member 202 will now be discussed in greater detail. The docking member 202 of the present embodiment may include a housing 204, an electrical device housing 240, and a primary connector 270.

The housing 204 of the docking member 202 may be configured to have one or more docking walls 206. The docking walls 206 may cooperate with each other to define an internal volume 208 of the docking member 202. In the present embodiment, the docking walls 206 cooperate to form a generally box-shaped internal volume 208. Any quantity and geometric configuration or arrangement of the docking walls 206, including circles, ellipses, triangles, rectangles, pentagons, hexagons, and any other polygon, are considered and within the scope of the invention.

Additionally, the housing 204 may be configured to permit at least a portion of the docking member 202 to be disposed within the bay 140 of the attaching member 102. Accordingly, the docking walls 206 may cooperate to define outer dimensions of a part of the docking member 202 that are less than the outer dimensions of the bay 140. As depicted in the present embodiment, the housing 204 may be configured such that a distal end 208 of the docking member 202 may be positioned in the bay 140.

Still referring to FIG. 5, the distal end 208 of the docking member 202 will now be discussed in greater detail. The docking walls 206 of the housing 204 may be configured to define a distal docking structure 210. The distal docking structure 210 may be configured to facilitate the attaching of the docking member 202 with the attaching member 102 and the coupling of any components associated with said attaching. The distal docking structure 210 may include distally-extending sections 212, a segmenting wall 214, a primary port 216, and one or more secondary ports 218. The distally-extending sections 212 may be configured and positioned to interface with a surface of the back wall 134 of the attaching member 102 to offset the segmenting wall 214 from the back wall 134. Furthermore, the distally-extending sections 212 may be configured and positioned to cooperate with the segmenting wall 214 to define an offset volume 220, the offset volume 220 being bounded by the distally-extending sections 212 and the segmenting wall 214. When the docking member 202 is positioned within the bay 140, the offset volume 220 may further being defined and bounded by a section of the back wall 134 of the attaching member 102.

Additionally, the distally-extending members may be configured an positioned so as to interface with a section of the back wall 134 such that the section of the back wall 134 defining and bounding the offset volume 220 may at least partially include the opening of the back wall 134. Where the distally-extending members are so configured and positioned, the docking member 202 may facilitate the positioning of an object within the bay 140, through the opening of the back wall 134, and into the offset volume 220.

Furthermore, the primary port 216 may be positioned within the segmenting wall 214. The primary port 216 may be positioned to permit an object to be positioned simultaneously within the offset volume 220 and the internal volume 208 of the housing 204. Accordingly, an embodiment having the above configuration and positioning may facilitate an object to be positioned simultaneously within the bay 140, through the opening of the back wall 134, into the offset volume 220, through the primary port 216, and into the internal volume 208 of the housing. Furthermore, such an object may also be positioned within the shielded volume of the attaching member 102. It is understood that this configuration may also facilitate the coupling and/or physical attachment or connection of two or more objects disposed within one or more of the shielded volume, the bay 140, the offset volume 220, and the internal volume 208 of the housing 204.

The secondary port 218 may be positioned within the segmenting wall 214. The secondary ports 218 may be selectively dimensioned to be differently sized than the primary port 216 or similarly sized. The secondary ports 218 may be positioned to permit an object to be positioned simultaneously within the offset volume 220 and the internal volume 208 of the housing 204. More specifically, the secondary ports 218 may be positioned and dimensioned to permit one or more electrical connectors, such as a wire, to be disposed therethrough, as discussed in greater detail hereinbelow.

The establishment of electrical connections between objects disposed within and without the internal volume 208 of the docking member 202 may be configured so as to require the positioning of the docking member 202 within the bay 140. More specifically, prior to the positioning of the docking member 202 within the bay 140, the assembly 100 may comprise an open circuit, one through which electricity is prevented from flowing. The open circuit comprised by the assembly 100 may be configured not to become a closed circuit until the docking member 202 is disposed within they bay 140 and removably attached to the attaching member 102. Such positioning of the docking member 202 may establish electrical connections between objects, namely electrical devices and power supplies, within and without the docking member 202, so as to close the circuit of the assembly 100, thereby enabling and permitting the flow of electricity therethrough. Such a configuration may reduce the risk of electrical shock to an individual handling the assembly 100, such as a person who is installing the assembly 100 on the structure 108.

In some embodiments, the structure 108 may be generally hollow, have an open end, and have one or more electrical connectors disposed through the hollow and extending generally outwards from the open end. Where the docking member 202 is disposed within the bay 140 with a distal docking structure 210 as described above, the electrical connectors may be permitted to de disposed within and/or be positioned so as to form an electrical connection with another electrical device disposed somewhere within the docking member 202, or additional electrical connectors so as to form said electrical connection. Moreover, it is appreciated that these electrical connections may be made prior to the disposal of the docking member 202 within the bay 140, and the electrical connections will be made upon disposal of the docking member 202 within the bay 140 and thereafter.

In one illustrative embodiment, the structure 108 is a street lamp post having a plurality of wires emerging from an open end. The attaching member 102 may be attached to the street lamp post. Furthermore, the attaching member 102 may further include a terminal block to which the plurality of wires of the street lamp post may be attached, thereby establishing an electrical connection with the terminal block. The electrical connection between the terminal block and the plurality of wires forms an open circuit, such that electricity cannot flow through the plurality of wires or the terminal block.

The terminal block may further include secondary connectors configured to establish an electrical connection with one or more electrical devices disposed within the docking member 202 when the docking member 202 is positioned within the bay 140 and is removably attached to the attaching member 102. The secondary connectors may be of any type that facilitates the establishment of electrical connections via the positioning of the docking member 202 within the bay 140. For example, and not by limitation, the secondary connectors may form a plug-and-socket electrical connection with the electrical devices disposed within the docking member 202, wherein the engagement between the secondary connectors and the electrical connectors of the electrical devices of the docking member 202 establishes an electrical connection therebetween. Accordingly, the electrical devices of the docking member 202 must include complementary electrical connectors so as to form an electrical connection with the secondary connectors. Where the secondary connectors are plug-and-socket connectors, the secondary connectors may be configured and positioned to form an electrical connection with the electrical devices of the docking member 202 when the docking member 202 is slid into the bay 140. Accordingly, both the docking member 202 and the attaching member 102 may be configured to facilitate the engagement between the secondary connectors and the electrical connectors of the electrical devices of the docking member 202 so as to form an electrical connection therebetween. Furthermore, the establishment of electrical connections between the secondary connectors and the electrical devices of the docking member 202 functions to form a closed circuit, such that electricity is enabled and permitted to flow from the wires of the street lamp post, through the terminal block and its secondary connectors, to the electrical devices of the docking member 202 and any other electrical devices of the assembly, to ground. Accordingly, a closed circuit is established when the electrical connectors of the electrical devices of the docking member 202 are engaged with the secondary connectors of the terminal block.

Figure 6:
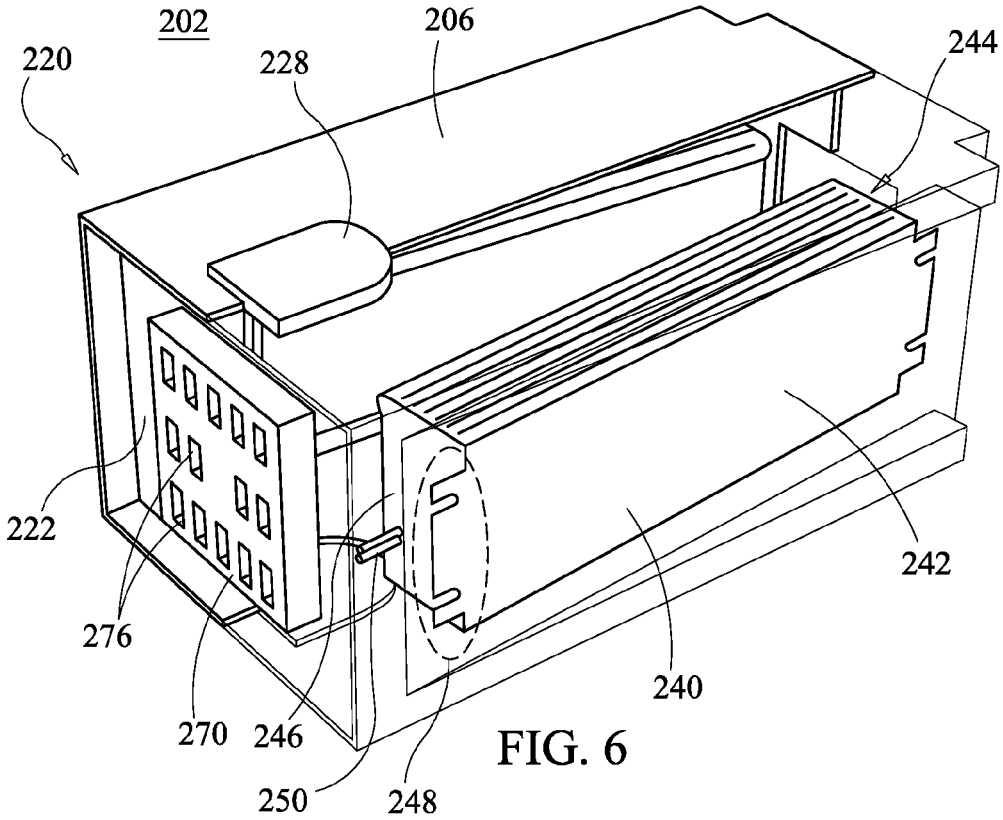
FIG. 6 is an alternate perspective view of the docking member depicted in FIG. 5.

Referring now to FIG. 6, the proximal end 220 of the docking member 202 will now be discussed in greater detail. The docking walls 206 of the docking member 202 may include a proximal wall 222. The proximal wall 222 may serve to define a distal boundary of the internal volume 208 of the docking member 202. The proximal wall 222 may further be configured to include have attached thereto and carry the primary connector 270.

Figure 7:
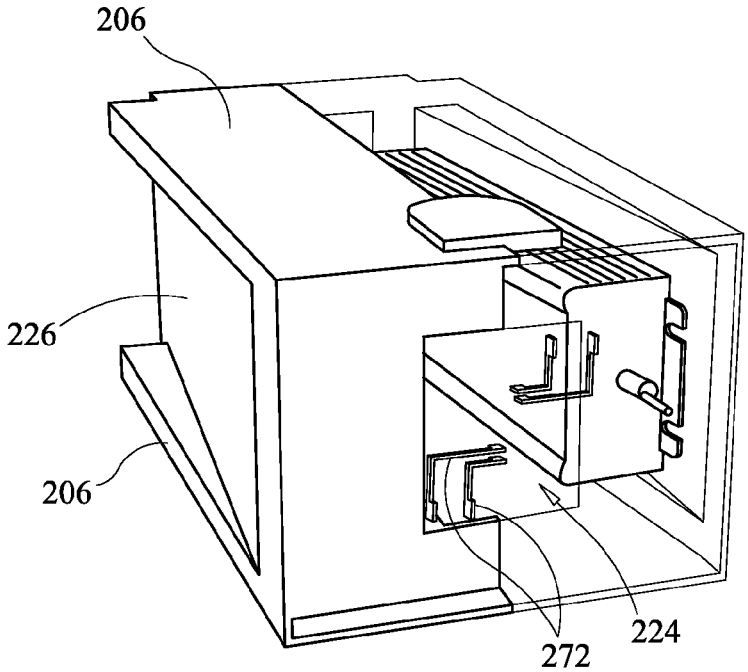
FIG. 7 is a partial perspective view of the docking member depicted in FIG. 6 with a primary connector removed.

Referring now to FIG. 7, the proximal wall 222 may include a proximal port 224 that facilitates the attachment of the primary connector 270 as well as the establishing of an electrical connection between the primary connector 270 and any object disposed within the internal volume 208 of the docking member 202. For example, the proximal port 224 may facilitate the attachment between the primary connector 270 and an electrical device disposed within the enclosed volume of an electrical device housing 240, as discussed in greater detail hereinbelow. The number, arrangement, and dimensions of proximal port 224 may vary according to the number and configuration of electrical connections to be made between the primary connector 270 and objects disposed within the internal volume 208, as well as the configuration of the primary connector 270.

The docking walls 206 of the housing 204 may further include features to facilitate the removable attachment between the docking member 202 and the attaching member 102. As depicted in the present embodiment, one such feature may be a slope. One or more of the docking walls 206 may include a sloped section 226. The sloped section 226 may be configured and positioned on the containing docking wall 206 so as to facilitate the removable attachment of the docking member 202 to the attaching member 102. As depicted in the present embodiment, and the embodiment of the attaching member 102 depicted in FIG. 4, the sloped section 226 may be configured to have a slope approximately equal to a slope defined by the sloped projecting sections 142. Furthermore, the sloped section 226 may be configured and positioned so that, when the docking member 202 is disposed within the bay 140, the sloped section 226 interfaces with the sloped projecting sections 142.

Moreover, in addition to interfacing with the sloped projecting section 142, the sloped section 226 may exert a generally outward-directed force against the sloped projecting section 142, to which the sloped projecting section 142 may exert a force generally opposite thereto. Accordingly, an interference fit may be established between the sloped section 226 and the sloped projecting section 142. The interference fit may facilitate the removable attachment of the docking member 202 to the attaching member 102.

The strength of the interference fit formed between the sloped section 226 and the sloped projecting section 142 may be determined by the surface characteristics of the sloped sections 226 and the sloped projecting sections 142. Additionally, the strength of the interference fit may be determined by the application of a generally distally-directed force by a user. The interference fit between the sloped sections 226 and the sloped projecting sections 142 may be released by a person exerting a generally proximally-directed force on the docking member 202.

The selection of docking walls 206 to include sloped sections 226 may be based upon the combination of determinations as to what docking walls 206 of the attaching member 102 will include sloped projecting sections 142 and the number and configuration of orientations that are desired between the docking member 202 and the attaching member 102.

The sloped sections 226 made be formed of a material that may be the same as or different from the material used in forming the containing docking wall 206. Furthermore, the sloped sections 226 may be formed of a material that includes desirable characteristics. Characteristics that may be included in deciding on the material may include, without limitation, mechanical strength, thermal conduction properties, and electrical conduction properties. In the present embodiment, the sloped sections 226 may be formed of a material that generally conducts heat. More specifically, the material may have a thermal conductivity value k of about or greater than 15.

Additionally, the sloped sections 226 may be configured so as to promote heat dissipation of the assembly 100 by cooperating with the attaching member 102 to conduct heat generally toward the attaching member 102, and, thereby to the external environment. Accordingly, the material used in forming the sloped sections 226 may be selected so as to facilitate the transfer of heat between the sloped sections 226 and the attaching member 102. More specifically, the material used in forming the sloped sections 226 may be selected based upon facilitating the transfer of heat between the sloped sections 226 and the sloped projecting sections 142. Selecting the material to form the sloped sections 226 may be based upon the material used to form the sloped projecting sections 142, and materials that may form a thermal coupling therebetween. Additionally, a mediating material, such as thermal grease, thermal gel, thermal compound, thermal paste, or the like, may be disposed between the sloped sections 226 and the sloped projecting sections 142 so as to increase the heat transfer capacity therebetween.

In other embodiments, the removable attachment between the attaching member 102 and the docking member 202 may be accomplished by other methods, mechanisms, devices, and features of the attaching member 102 and the docking member 202. Examples of such methods, mechanisms, devices, and features of removably attaching the docking member 202 to the attaching member 102 include, without limitation, cooperating magnets, tab-and-receiver slot systems, fasteners, rotation-based respective interfering structures, clips, and any other methods, mechanisms, devices, and features that are known in the art are contemplated and included within the scope of the invention.

Referring now to FIG. 6, another feature of the docking member 202 will now be discussed in greater detail. One or more of the docking walls 206 may include a stop 228. The stop 228 may be configured as a projecting section of the containing wall 206. Furthermore, the stop 228 may be configured to facilitate the removable attachment between the docking member 202 and the attaching member 102. More specifically, the stop 228 may be configured to cooperate with a feature of the attaching member 102 to define one or more orientations between the docking member 202 and the attaching member 102. As depicted in the present embodiment of the docking member 202 and the attaching member 102 of FIG. 6, the stop 228 may be configured to cooperate with the slot 152 of the cover walls 138 of the attaching member 102 so as to be disposed within the slot 152 when the docking member 202 is disposed within the bay 140. The stop 228 may be configured to abut the cover wall 138 containing the slot 152 such that the cover wall 138 prevents further distal translation of the stop 228 beyond that point, thereby limiting distal translation of the docking member 202 in the bay 140.

Referring now to FIG. 6, the electrical device housing 240 of the present embodiment will now be discussed in greater detail. The electrical device housing 240 may be configured and dimensioned to be disposed within the internal volume 208 of the docking member 202. Furthermore, the electrical device housing 240 may be configured to define an enclosed volume dimensioned to accommodate an electrical device to be disposed therein. The electrical device housing 240 may include one or more side walls 242, a distal end wall 244, and a proximal end wall 246. The side walls 242 may cooperate with the distal end wall 244 and the proximal end wall 246 to define the enclosed volume.

The electrical device housing 240 may be configured to include characteristics to facilitate the operation of an electrical device disposed within the enclosed volume. For example, the electrical device housing 240 may be configured to include features that facilitate the dissipation of heat. In the present embodiment, the side walls 242 may include features such as slots, grooves, and ridges that increase the surface area of the containing side wall, thereby increasing the heat dissipation capacity of the containing side wall, and hence the electrical device housing 240.

The slots, grooves, and ridges, as well as the side walls 242 as a whole, may be placed in thermal communication with any electrical device disposed within the enclosed volume so as to promote the dissipation of heat generated by the operation of the electrical device. Moreover, the side walls 242 may be formed of a material that generally conducts heat, more specifically having a thermal conductivity value k of about or greater than 15.

The electrical device housing 240 may be configured to attach to the docking walls 206 of the docking member 202. More specifically, the electrical device housing 240 may be configured to attach to the sloped sections 226 of the docking walls 206 of the docking member 202. As depicted in the present embodiment, the side walls 242 may include fastening sections 248 configured to facilitate attaching the electrical device housing 240 to the sloped sections 226. The fastening sections 248 may be configured to accommodate a fastener to exert a force on the fastening section 248 of sufficient strength to attach the electrical device housing 240 to the sloped section 226. Any appropriate fastener may be used, including, but not limited to, screws, nails, staples, brads, rivets, glues, adhesives, and all other fasteners known in the art.

In embodiments of the invention where the electrical device housing 240 is attached to the sloped section 226, one or more of the side walls 242 may interface with the sloped section 226. The interfacing side walls 242 may be configured to facilitate the transfer of heat from the interfacing side wall 242 to the sloped section 226. For instance, the interfacing side wall 242 may be configured to increase the amount of surface area forming the interface between the interfacing side wall 242 and the sloped section 226. In the present embodiment, where the sloped section 226 is generally flat, the interfacing side wall 242 may be configured to be similarly generally flat. Furthermore, the material used in forming the interfacing side wall 242 may be selected so as to increase the heat transfer capacity from the interfacing side wall 242 to the sloped section 226. Additionally, a mediating material, such as thermal grease, thermal gel, thermal compound, thermal paste, or the like, may be disposed between the interfacing side wall 242 and the sloped section 226 so as to increase the heat transfer capacity therebetween.

The electrical device housing 240 may be configured to accommodate the functional coupling between electrical devices disposed within the enclosed volume of the electrical device housing 240 and electrical devices disposed external the enclosed volume. As depicted in the present embodiment, the distal end wall 244 and the proximal end wall may 246 include a port 250. The port 250 may be configured to permit one or more electrical connectors, such as wires, to be disposed therethrough, enabling a physical connection between an electrical device disposed within the enclosed volume and an electrical disposed external the enclosed volume. Additionally, the material forming the side walls 242, proximal end wall 246, and distal end wall 244 may generally permit the transmittal or propagation of electromagnetic radiation, such as radio waves, therethrough. Alternatively, where it is desirable for the electrical device disposed in the enclosed volume to be shielded from electromagnetic radiation, the material forming the side walls 242, proximal end wall 246, and distal end wall 244 may generally prevent the transmittal or propagation of electromagnetic radiation therethrough.

As depicted in the present embodiment, the docking member 202 may comprise more than one electrical device housing 240. Any number of electrical device housings 240 are contemplated and included within the scope of this invention. Where there are more than one electrical device housings 240, they may be attached to the docking walls 206 of the docking member 202 in any desirable configurations. For instance, the electrical device housings 240 may be attached to the docking walls 206 of the docking member 202 so as to reduce the respective temperatures of the electrical devices disposed within each of the electrical device housings 240.

In the present embodiment, each electrical device housing 240 is attached to a docking wall 206 of the docking member 202 including a sloped section 226. Those docking walls 206 containing sloped sections 226 are generally opposite each other, therefore attaching each of the electrical device housings 240 to each sloped section 226 results in the maximum heat dissipation capacity by establishing thermal communication between the electrical device housings 240 and their respective attached sloped sections 226 as well as distancing each of the electrical device housings 240 from each other, thereby avoiding the concentration of heat-generating elements, such as the electrical devices disposed within the enclosed volumes of the electrical device housings 240, within certain areas of the internal volume 208 of the docking member 202.

The electrical device housing 240 may have disposed in its enclosed volume an electrical device. The types of electrical devices that may be disposed therein are constrained only be the dimensional and heat dispersion characteristics of the electrical device housing 240, the docking member 202, and the attaching member 102. In some embodiments, the docking member 202 may include an electrical device housing 240 having a power supply unit disposed within its enclosed volume.

The power supply unit may be configured to electrically couple with an external power supply. The electrical coupling between the power supply unit and the external power supply may be established, for instance, through the electrical connection between wires associated with the structure 108 and the power supply unit. In such an embodiment, one of the wires associated with the structure 108 may provide a voltage, defined as a power wire. The voltage supplied by the power wire may be of any current, magnitude, and modulation. Accordingly, the power supply unit may be configured to accommodate varying forms of voltage, including DC voltage, AC voltage, and various modulations of voltage known in the art. Additionally, the power supply unit may be configured to receive the voltage from the power wire and convert and condition the power to voltage of appropriate current, magnitude, and modulation so as to be used to energize and render operable the various electrical devices of the assembly.

In some embodiments, the docking member 202 may include first and second power supply units and a control unit. Power supply units have an expected number of hours of operation before failure. Accordingly, the control unit may be configured to operate the first power supply unit for a predetermined number of hours, discontinue operation of the first power supply unit when the predetermined number of hours is reached, and then enable operation of the second power supply unit. Alternatively, the control unit may be configured to operate the first power supply unit until the first power supply unit is detected to have failed, and then enable operation of the second power supply unit. Furthermore, where the control unit is operationally coupled with a communication device, or otherwise able to communicate across a network, as discussed in greater detail hereinbelow, the control unit may generate a signal indicating the failure of the first power supply unit to be received by an associated receiver.

Furthermore, the docking member 202 may include a controller as an electrical device. The controller may be configured to control the operation of an electrical device associated with either of the docking member 202 and the load member 302. Where the controller is configured to control the operation of an electrical device associated with the load member 302, the controller may be configured to communicate with said electrical device through electrical coupling via the primary connector 270, as discussed in greater detail hereinbelow.

Furthermore, the docking member 202 may include a communication device as an electrical device. The electrical device may be configured to communicate across a network, such as the internet, with other electrical devices connected to the same network. Moreover, the communication device may be configured to enable communication across said network for any other electrical device associated with the docking member 202 or the load member 302. The communication device may communicate across the network according to any wired or wireless communication standard or protocol known in the art. Where a wired protocol is employed, a wired connection must be established between the communication device and the wired network. For example, as described hereinabove, the communication device may be in electrical communication with one or more of the plurality of wires associated with the structure 108. One or more of the plurality of wires may be configured to enable the wired communication between the communication device and the wired network, as is known in the art.

An embodiment of the invention involving a plurality of assemblies communicating across a network to control their operation is provided in U.S. patent application Ser. No. 13/465,921, entitled "Sustainable Outdoor Lighting Systems and Associated Methods" (hereinafter "the '921 application"), the entirety of which is incorporated herein by reference. However, whereas the invention described in the '921 application is directed to lighting systems, the invention of the present embodiment is directed to systems intended for purposes other than, or in addition to, lighting. Additionally, the present application may be electrically coupled to an external power supply in addition to the power supply disclosed in the '921 application.

Referring now to FIG. 6, the primary connector 270 of the docking member 202 will now be discussed in greater detail. The primary connector 270 of the docking member 202 may be electrically coupled with any electrical devices disposed within the internal volume 208 of the docking member 202. Additionally, the primary connector 270 may be configured to electrically couple to the load member 302. More specifically, as depicted in FIG. 7, the primary connector 270 may be configured to include a sufficient number and configuration of intermediate connectors 272 to facilitate the electrical coupling between at least one of the electrical devices disposed within the internal volume 208 of the docking member 202 and the load member 302.

The electrical coupling between the electrical devices of the docking member 202 and the load member 302 may enable the transmission of power to the load member 302.

Additionally, the electrical coupling between the electrical devices of the docking member 202 and the load member 302 may enable the transmission and reception of data between the electrical devices of the docking member 202 and the load member 302. The transmission of power and the transmission of data to and reception of data from the load member 302 may include, by relation, any electrical devices associated with and/or comprised by the load member 302.

The primary connector 270 may be configured to enable the electrical coupling between various embodiments of the docking member 202 and the load member 302. More specifically, the primary connector 270 may be configured to enable electrical between various embodiments of the docking member 202 having a varied number of electrical devices associated therewith and requiring varying numbers and configurations of connections, as well as the attending connections necessary to electrically couple the load member 302 thereto.

Figure 8:
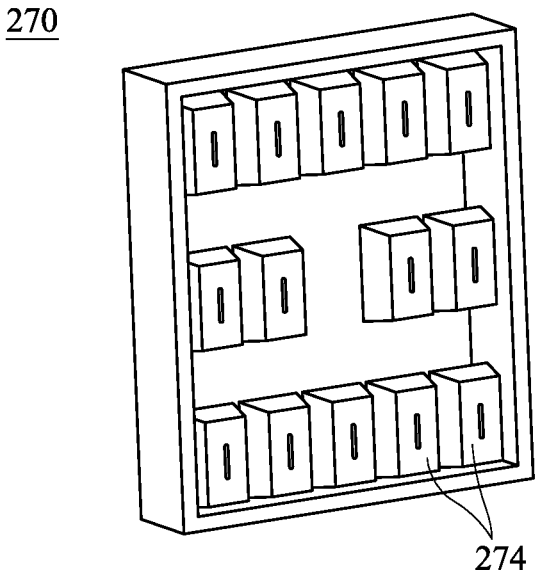
FIG. 8 is a perspective view of a primary connector of the modular segmented electronics assembly according to an embodiment of the present invention.

Referring now to FIG. 8, to facilitate the electrical coupling of electrical devices disposed within the internal volume 208 of the docking member 202 and the primary connector 270, the primary connector 270 may comprise a plurality of distal connectors 274. The distal connectors 274 may be any electrical connectors known in the art, including, without limitation, terminals, terminal blocks, posts, crimp connectors, plugs, sockets, and all other electrical connectors. The primary connector 270 may include any number of distal connectors 274 and in any variation, arrangement, and combination of different types of connectors.

Referring now to FIG. 6, the primary connector 270 may further include a plurality of proximal connectors 276. Similar to the distal connectors 274, the proximal connectors 276 may be any electrical connector known in the art, and may be include any number, configuration, and combination of electrical connectors. In some embodiments, it may be desirous the quantity, configuration, and arrangement of proximal connectors 276 to be predetermined, such as according to a standard. The standard may be set by a standard-setting authority, or it may be a standard established unilaterally so as to establish a proprietary standard.

Furthermore, the proximal connectors 276 may be configured to accommodate various modes of engaging corresponding electrical connectors of the load member 302. More specifically, the proximal connectors 276 may be configured to engage with electrical connectors of the load member 302 according to various angles of approach, rotation, longitudinal translation, and any other methods and vectors of approach traversed by the load member 302 when attaching to the attaching member 102.

Figure 9:
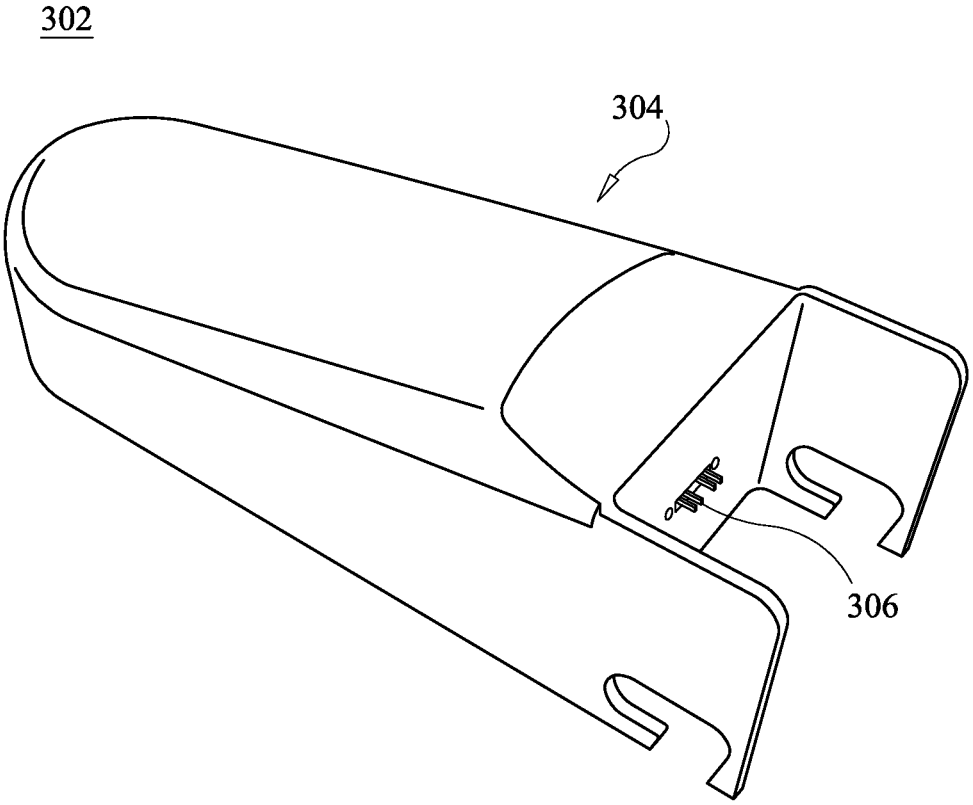
FIG. 9 is a perspective view of a load member of the modular segmented electronics assembly according to an embodiment of the present invention.

Referring now to FIG. 9, the load member 302 of the assembly 100 will now be discussed in greater detail. The load member 302 may include a load housing 304, an electrical device, and a load connector 306. The load housing 304 may be configured to attach to the attaching member 102 so as to removably attach the load member 302 to the attaching member 102. The electrical device may be attached to and carried by the load housing 304 so as to be suspended from the structure 108. The load connector 306 may be an electrical connector configured to engage with and electrically couple to the primary connector 270 of the docking member 202.

The load housing 304 may be configured to facilitate the attachment and detachment of the load member 302 to the attaching member 102. As depicted in the embodiment of the invention of FIG. 10, the load housing 304 may include a load top wall 308 and load side walls 310.

The load side walls 310 may be configured to cooperate with features of the attaching member 102 so as to removably couple the load member 302 to the attaching member 102. More specifically, the load side walls 310 may include a tortuous slot 312 configured to accommodate a feature of the attaching member 102.

Figure 10:
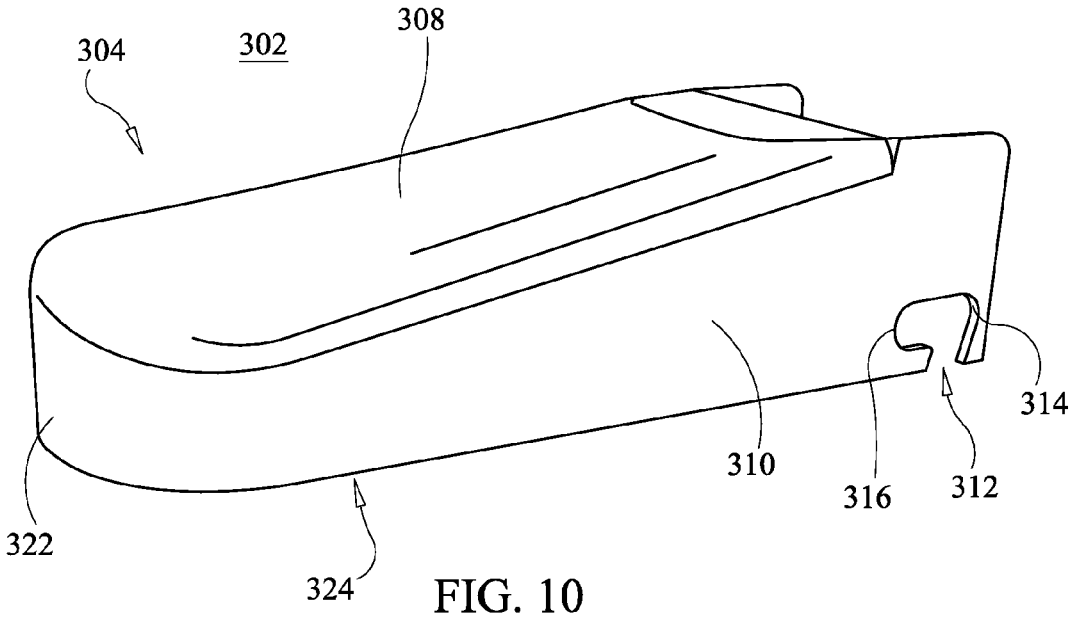
FIG. 10 is an alternate perspective view of the load member depicted in FIG. 9.

As depicted in FIG. 10, the tortuous slot 312 may be configured to accommodate the positioning of an outcropping 160 of the attaching member 102. More specifically, the tortuous slot 312 may be configured to form an opening in an edge of the containing load side wall 310, include a turn 314, and include an end 316. Accordingly, the outcropping 160 may be permitted to enter the tortuous slot 312, traverse through the tortuous slot 312 and past the turn 314 until reaching the end 316, such that when the outcropping 160 is positioned at the end 316, the load member 302 has been removably attached to the attaching member 102. Accordingly, the positioning of the tortuous slot 312 and the outcropping 160 may be configured on each of the load member 302 and the attaching member 102 so as to facilitate the removable attachment therebetween. Moreover, the configuration of the tortuous slot 312, more specifically the distances and orientations between the opening in the edge of the containing load side wall 310, the turn 314, and the end 316, may be configured so as to facilitate the removable attachment between the load member 302 and the attaching member 102.

Additionally, the tortuous slot 312 may be configured to as to facilitate the engagement between the load connector 306 and the primary connector 270 of the docking member 202, discussed in greater detail hereinbelow. Other methods of attaching the load member 302 to the attaching member 102, such as use of fasteners, welding, electromagnetic coupling, and any other method known in the art, are included within the scope of the invention.

The load member 302 may be attached to the attaching member 102 so as to prevent the accidental, unintentional, or otherwise unplanned detachment of the load member 302 from the attaching member 102. Such unplanned detachments may occur as a result of the exertion of environmental forces, such as wind, earthquake, or other natural phenomena. Accordingly, the attachment between the load member 302 and the attaching member 102 must be of sufficient strength and resiliency so as to withstand the exertion of forces other than those exerted by an individual intending to detach the load member 302 from the attaching member 102.

Figure 11:
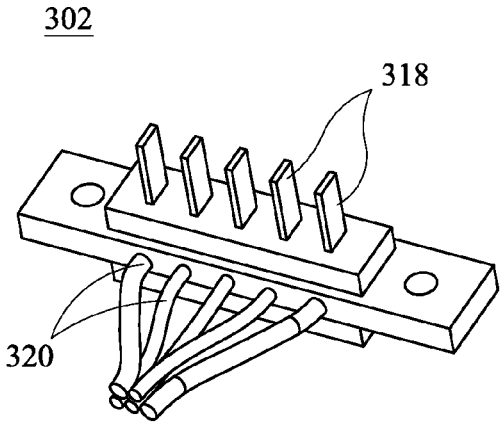
FIG. 11 is a perspective view of a load connector of the modular segmented electronics assembly according to an embodiment of the present invention.

Referring now to FIG. 11, the load connector 306 will now be discussed in greater detail. The load connector 306 may be configured to engage with and electrically couple to the primary connector 270 of the docking member 202. More specifically, the load connector 306 may be configured to facilitate the electrical coupling between the electrical devices of the docking member 202 and any electrical devices disposed within the load housing 304 or any other electrical device associated with the load member 302.

The load connector 306 may include one or more distal load connectors 318. Any number, configuration, and positioning of distal load connectors 318 are included within the scope of the invention. Additionally, the load connector 306 may include a number, configuration, and positioning of distal load connectors 318.

The distal load connectors 318 may be configured to engage with the proximal connectors 276 of the primary connector 270 so as to form an electrical coupling therebetween. For example, the distal load connectors 318 and the proximal connectors 276 may form a plug-and-socket connection, whereby the disposal of one within the other establishes an electrical coupling therebetween. Moreover, the configuration of the proximal connectors 276 and the distal load connectors 318 may facilitate the attachment of the load member 302 to the attaching member 102 by permitting rotation, horizontal/vertical translation, or any other variety or combination of displacements of one of the distal connectors 274 and the proximal load connectors 320 within the other, thereby permitting according displacements of the load member 302, attaching member 102, or both.

The proximal connectors 276 may permit the distal load connectors 318 to rotate therewithin about a transverse rotational axis, thereby allowing the outcropping 160 to rotate within the tortuous slot 312, thereby permitting the load member 302 to attach to the attaching member 102, as described hereinabove. The nature of the displacement required by the attaching between the load member 302 and the attaching member 102 will dictate the necessary permissible displacement between the distal connectors 274 and the proximal load connectors 320, and vice versa.

The load connector 306 may further include one or more proximal load connectors 320. The load connector 306 may include any number, configuration, and positioning of proximal load connectors 320. More specifically, the load connector 306 may include a number, configuration, and positioning of proximal load connectors 320 so as to electrically couple to the electrical devices associated with the load member 302. Moreover, the proximal load connectors 320 may be electrically coupled with the distal load connectors 318 so as to electrically couple the electrical devices of the load member 302 to the proximal connectors 276 of the primary connector 270 and, by extension, to the primary connector 270 itself, and further to the electrical devices of the docking member 202.

The load member 302 may have associated with it one or more load electrical devices. As depicted in FIG. 10, the load housing 304 may have load side walls 310 and a load top wall 308, as described hereinabove, and may further include a load proximal wall 322. The load side walls 310, load top wall 308, and load proximal wall 322 may cooperate so as to define a covered region 324. The load electrical devices associated with the load member 302 may be disposed within the covered region 324 of the load housing 304. When so disposed, the load housing 304 may generally shield the load electrical devices disposed within the covered region 324 from environmental factors, such as rain, snow, wind, etc.

Any type of electrical device may be associated with the load member 302. Furthermore, any electrical device of appropriate dimensions may be disposed within the covered region 324. Yet further, any load electrical device may be electrically coupled to the proximal load connectors 320. Types of load electrical devices included within the scope of the invention include, without limitation, lighting devices, motion detectors, electromagnetic sensors, communication devices, such as devices to facilitate radio, wireless telephone, or wireless computer communication according to any standard or protocol, visual display, loudspeaker, or any other electrical device.

Moreover, through connection with a power source via electrical coupling between the load connector 306, primary connector 270, and electrical devices of the docking member 202, the load electrical devices may be energized and rendered operable by an external power source. Where a load electrical device requires electricity of a certain voltage, current, waveform, or any other modulation, the docking member 202 may include an electrical device configured to supply power to meet such requirements, and the primary connector 270 and load connector 306 may be configured to enable delivery of such power to the load electrical device.

Additionally, where the electrical devices of the docking member 202 enable electronic communication across a network, such an electrical device may enable communication by a load electrical device across said network via communication between the load electrical device and the electrical device of the docking member 202. Conversely, where a load electrical device enables communication across a network, such as the internet, any other load electrical device or electrical device of the docking member 202 may communicate across said network via communication with the load electrical device.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

What is claimed is:

1. A modular segmented street lighting device comprising: an attaching member adapted to be attachable to a street lamp pole, the attaching member comprising: an electrical connector adapted to be electrically coupled to a power source associated with the street lamp pole, and a cover wall; a docking member adapted to be removably attachable to the attaching member, the docking member comprising a power supply unit; and a load member adapted to be removably attachable to at least one of the attaching member and the docking member, the load member comprising a lighting device; wherein the docking member is adapted to electrically couple the power supply unit to the electrical connector of the attaching member when the docking member is attached to the attaching member; wherein the load member is adapted to electrically couple the lighting device to the power supply unit when the load member is attached to at least one of the attaching member and the docking member; and wherein the docking member comprises an outcropping configured to be received by a slot formed at a proximal end of the cover wall so as to position the docking member in a selected orientation, and the attaching member is configured to facilitate the sliding translation of the docking member there into in a fixed angular orientation to a fixed depth with respect to the attaching member.

2. The street lighting device of claim 1 wherein the attaching member further comprises a back wall; wherein the back wall and the cover wall cooperate to define a bay and a shielded volume; and wherein the docking member is configured to be positioned at least partially within the bay.

3. The street lighting device of claim 2 wherein the back wall further comprises an opening configured to permit the positioning of an object partially within the bay and partially within the shielded volume.

4. The street lighting device of claim 1 wherein the power supply unit comprises two power supply units and a control unit; wherein the control unit is configured to operate a first of the two power supply units to provide power to the lighting device of the load member; wherein the control unit is configured to detect a failure of the first power supply unit; and wherein the control unit is configured to, upon a detection of the failure of the first power supply unit, operate the second of the two power supply units to provide power to the load member.

5. The street lighting device of claim 4 further comprising a communication device positioned in communication with a network; wherein the control unit is configured to generate a signal indicating the failure of the first power supply unit to be transmitted by the communication device and received by a receiver across the network.

6. The lighting device of claim 1 wherein the docking member comprises a primary connector; wherein the load member comprises a load connector; and wherein the load connector is configured to electrically couple to the primary connector when the load member is attached to the docking member.

7. The lighting device of claim 6 wherein the primary connector is configured to facilitate engagement with the load connector by permitting engagement in a range of angles of approach, rotation, horizontal rotation, and vertical translation.

8. The street lighting device of claim 1 further comprising an upper cover member and a lower cover member; wherein the upper and lower cover members are configured to be disposed about and substantially shield at least one of the attaching member, the docking member, and the load member from environmental factors.

9. The street lighting device of claim 1 wherein the cover wall comprises at least one feature selected from the group consisting of slots, grooves, ridges, slopes, and tapers.

10. The street lighting device of claim 1 wherein the cover wall comprises a feature configured to increase a thermal dissipation capacity of the street lighting device.

11. The street lighting device of claim 1 wherein the slot of the cover wall is configured to permit the positioning of an electrical device therein or therethrough.

12. The street lighting device of claim 1 wherein the docking member is configured to be attached to the attaching member by translating longitudinally into the bay.

13. The street lighting device of claim 1 wherein the docking member is configured to form an open circuit when the load member is not attached thereto.

14. The street lighting device of claim 1 further comprising a controller; wherein the load member comprises a load electrical device positioned in electrical communication with the controller; and wherein the controller is configured to control the operation of the load electrical device.

15. A modular segmented street lighting device comprising:

an attaching member adapted to be attachable to a street lamp pole, the attaching member comprising:

an electrical connector adapted to be electrically coupled to a power source associated with the street lamp pole, a back wall, and one or more cover walls, at least one of the one or more cover walls comprising a slot, wherein the back wall and the cover walls cooperate to define a bay and a shield volume;

a docking member adapted to be removably attachable to the attaching member, the docking member comprising:

a power supply unit, an outcropping configured to be received by the slot of the cover walls so as to facilitate the sliding translation of the docking member in a fixed angular orientation with respect to a longitudinal axis of the attaching member there into to a fixed depth with respect to the attaching member; and a load member adapted to be removably attachable to at least one of the attaching member and the docking member, the load member comprising a lighting device;

wherein the docking member is adapted to electrically couple the power supply unit to the electrical connector of the attaching member when the docking member is attached to the attaching member;

wherein the docking member is configured to be positioned at least partially within the bay;

wherein the docking member is configured to be attached to the attaching member by translating longitudinally into the bay;

wherein the load member is adapted to electrically couple the lighting device to the power supply unit when the load member is attached to at least one of the attaching member and the docking member.

16. The street lighting device of claim 15 wherein the docking member comprises two power supply units and a control unit; wherein the control unit is configured to operate a first of the two power supply units to provide power to the load unit; wherein the control unit configured to detect a failure of the first power supply unit; and wherein, upon a detection of the failure of the first power supply unit, and the control unit is configured to operate the second of the two power supply units to provide power to the load member.

17. The street lighting device of claim 16 further comprising a communication device positioned in communication with a network; wherein the control unit is configured to generate a signal indicating the failure of the first power supply unit to be transmitted by the communication device and received by a receiver across the network.

18. The street lighting device of claim 15 further comprising an upper cover member and a lower cover member; wherein the upper and lower cover members are configured to be disposed about and substantially shield at least one of the attaching member, the docking member, and the load member from environmental factors.

* * * * *